US007660660B2

(12) United States Patent
Butts et al.

(10) Patent No.: US 7,660,660 B2
(45) Date of Patent: Feb. 9, 2010

(54) SYSTEMS AND METHODS FOR REGULATION OF ENGINE VARIABLES

(75) Inventors: Kenneth Roy Butts, Grosse Point Woods, MI (US); Christopher R. Vermillion, Ann Arbor, MI (US); Jing Sun, Ann Arbor, MI (US)

(73) Assignees: Toyota Motor Engineering & Manufacturing North America, Inc., Erlanger, KY (US); The Regents of the University of Michigan, Ann Arbor, MI (US)

( * ) Notice: Subject to any disclaimer, the term of this patent is extended or adjusted under 35 U.S.C. 154(b) by 533 days.

(21) Appl. No.: 11/673,450

(22) Filed: Feb. 9, 2007

(65) Prior Publication Data

US 2008/0190384 A1 Aug. 14, 2008

(51) Int. Cl.
*F01P 7/14* (2006.01)
*F01P 3/00* (2006.01)

(52) U.S. Cl. ..... 701/102; 123/41.02

(58) Field of Classification Search ..... 701/102, 701/101, 115; 123/41.02, 41.21, 41.25, 41.31, 123/41.33

See application file for complete search history.

(56) References Cited

U.S. PATENT DOCUMENTS 5,092,282 A * 3/1992 Danekas et al. ..... 123/41.21
5,130,920 A 7/1992 Gebo
5,467,745 A 11/1995 Hollis
5,505,164 A 4/1996 Hollis
5,507,251 A 4/1996 Hollis
5,657,722 A 8/1997 Hollis
5,669,335 A 9/1997 Hollis
5,778,326 A 7/1998 Moroto
5,806,479 A 9/1998 Bauer et al.
5,983,628 A * 11/1999 Borroni-Bird et al. ..... 60/274
6,044,808 A 4/2000 Hollis
6,344,732 B2 2/2002 Suzuki
6,362,602 B1 3/2002 Kozarekar
6,487,477 B1 11/2002 Woestman
6,684,826 B2 2/2004 Yoshikawa et al.
6,687,581 B2 2/2004 Deguchi
6,764,020 B1 7/2004 Zhao et al.
6,772,715 B2 * 8/2004 Pfeffinger et al. ..... 123/41.31
6,779,737 B2 8/2004 Murray et al.
6,856,866 B2 2/2005 Nakao
6,904,875 B2 6/2005 Kilger (Continued)

OTHER PUBLICATIONS

"Thermostat, thy days are numbered; the dawn of intelligent engine cooling," Ward's Auto World, Jun. 1, 2001. Retrieved on Sep. 8, 2006 from http://findarticles.com/p/mi_m3165/is_2001_June_1/ai_75521691/print.

(Continued)

*Primary Examiner*—Hieu T Vo
(74) *Attorney, Agent, or Firm*—Dinsmore & Shohl LLP

(57) ABSTRACT

A method for controlling an engine output with at least two actuators, including applying inputs to actuators which regulate a variable of an engine, evaluating the response of the system, determining the ability of the actuators to change the engine variable, determining the capability of the actuators to reject a disturbance, calculating an optimum actuator feedforward control function based upon the ability and capability determined and controlling the actuators using the calculated function and a feedforward control algorithm.

20 Claims, 6 Drawing Sheets

U.S. PATENT DOCUMENTS 6,915,649 B2 * 7/2005 Amaral et al. ..... 62/244

OTHER PUBLICATIONS

Koay, K. L. and Bugmann, G. "Compensating Intermittent Delayed Visual Feedback in Robot Navigation" article. School of Computing, Communications and Electronics, University of Plymouth, Plymouth, United Kingdom.

Setlur, P., Wagner, J., Dawson, D. And Chen, J. "Nonlinear Controller for Automotive Thermal Management Systems" article. Automotive Research Laboratory, Clemson University, Clemson, South Carolina.

* cited by examiner

SYSTEMS AND METHODS FOR REGULATION OF ENGINE VARIABLES

TECHNICAL FIELD

This invention generally relates to systems and methods for choosing optimal actuator control inputs to regulate an engine variable setpoint and, more specifically, one embodiment relates to systems and methods for evaluating responses of multiple actuators for optimum simultaneous control of these actuators for improved management of engine variables where the number of variables is less than the number of actuators.

BACKGROUND

Generally, when mapping an engine on a dynamometer, coolant and oil temperatures must be regulated to specific setpoints. To achieve such specific setpoints, a heater and heat exchanger are employed to heat and cool parallel liquid flows. These flows are subsequently combined using a mixing valve to achieve a desired setpoint.

In most systems of this type, the heater and mixing valve are used at different times. Specifically, the heater is controlled to raise the temperature when the actual temperature is below the setpoint, and the mixing valve is controlled in other situations when the actual temperature is above the setpoint. Accordingly, the heater is used for temperature increases and the valve for temperature decreases. However, such systems can suffer from slow setpoint response, ineffective calibration and, ultimately, inaccurate temperature regulation. Accordingly, there is a need for systems and methods that achieve accurate temperature regulation and fast dynamic response. There is also a need for improved methods of control and/or assessing control authority of actuators of a powertrain system.

SUMMARY

Accordingly, embodiments of the present invention may simultaneously control actuators to optimally regulate an engine variable to a particular setpoint.

According to one aspect, a method for controlling an engine output with at least two actuators is provided comprising providing inputs to the actuators (e.g., via applying or simulating the inputs) which regulate an engine variable and evaluating the response of the actuators. The method further comprises determining the ability of the actuators to change the engine variable and determining the capability of the actuators to reject a disturbance. The method further comprises calculating a fitness function based upon the ability and capability determined and controlling the actuators using the calculated function and a feedforward control algorithm.

According to another aspect, a method for feedforward control of an engine variable wherein at least two actuators regulate an engine variable is provided comprising establishing an engine variable setpoint and evaluating the fitness of the actuators to produce the setpoint. The method further comprises determining optimal actuator input settings and feeding forward optimal actuator input settings.

According to another aspect, an engine control system is provided comprising at least two actuators wherein the at least two actuators regulate one or more engine variables, where the number of engine variables is less than the number of actuators. The system further comprises a controller and/or model that simulates the response to inputs to the at least two actuators to evaluate a response of the performance variable, wherein the simulation is further operative to use the response for simultaneous feedforward control of the actuators for control of the engine variable. Alternatively, the actual, as opposed to simulated, response, of the system may be used as part of the actual commissioning process to evaluate the response of the performance variable.

Still other embodiments, combinations and advantages will become apparent to those skilled in the art from the following descriptions wherein there are shown and described alternative illustrative embodiments of this invention for illustration purposes. As will be realized, the invention is capable of other different aspects, objects and embodiments all without departing from the scope of the invention. Accordingly, the drawings and description should be regarded as illustrative only and not as restrictive.

BRIEF DESCRIPTION OF THE DRAWINGS

It is believed that the present invention will be better understood from the following description taken in conjunction with the accompanying drawings in which.

DETAILED DESCRIPTION OF ILLUSTRATIVE EMBODIMENTS

Figure 1:
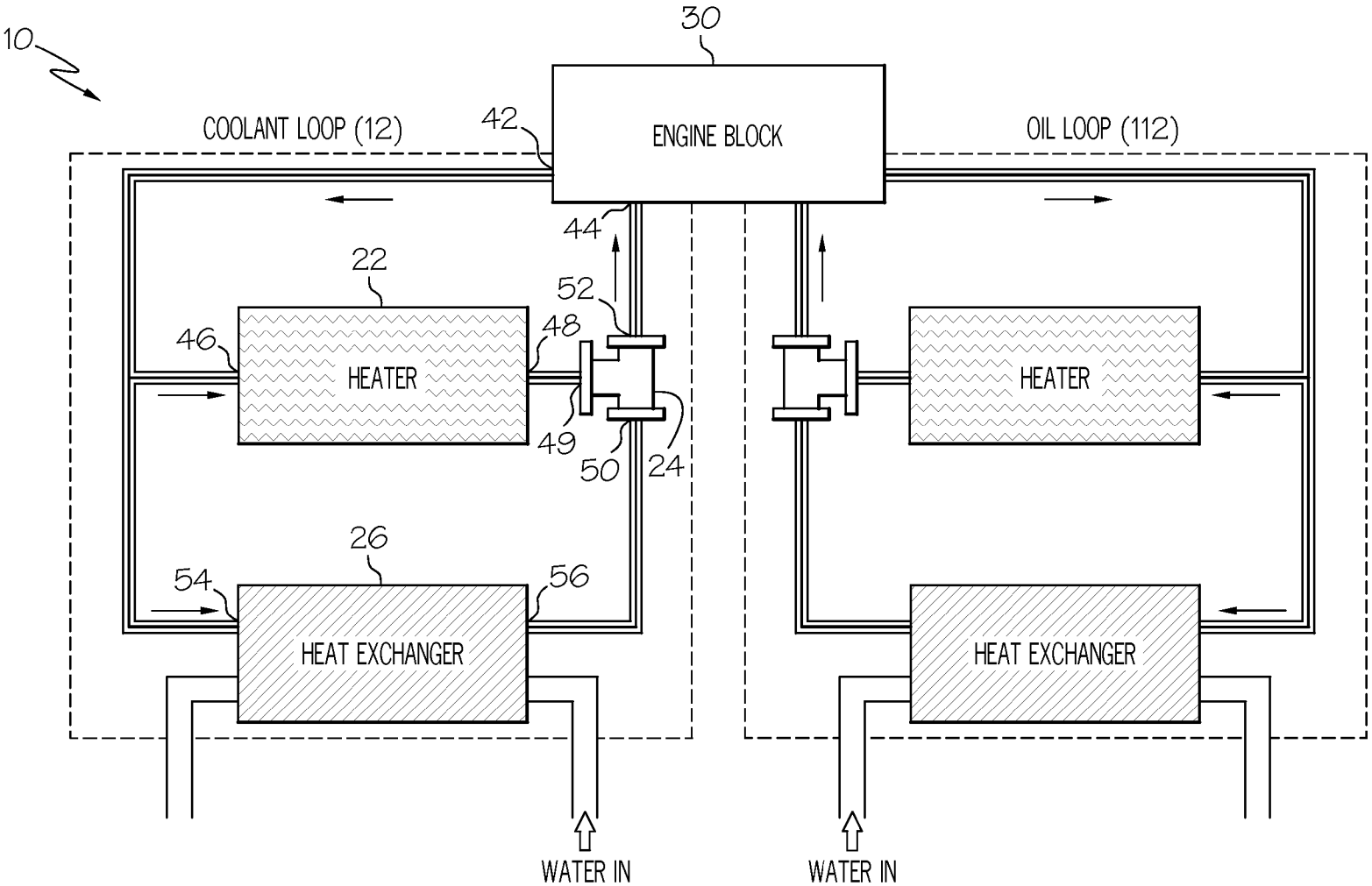
FIG. 1 is a general view of a thermal engine management system for regulating an engine variable in accordance with one illustrative embodiment of the present invention.

Referring to the drawing figures in detail, wherein corresponding numerals indicate the corresponding elements throughout the drawings, FIG. 1 illustrates a thermal management system 10 for regulating engine oil and coolant temperatures, according to one embodiment. As illustrated and discussed more fully below, thermal management system 10 may comprise an engine block 30, a coolant system 12, and an oil system 112. As illustrated, engine block 30 may be an internal combustion engine commonly used in automobiles. However, various powertrain systems and engines, including hybrid, electric, diesel, and other engines, for example, as well as other thermal control systems may be implemented. Coolant and oil may be received from engine block 30, circulated through coolant system 12 and oil system 112 and returned to engine block 30, such that the temperature of engine block 30 may be regulated. While it is contemplated that coolant system 12 and oil system 112 may circulate coolant and oil, other systems are contemplated where other engine media may be used to cool engine block 30. For example, any engine media capable of thermal regulation may be circulated through systems 12 and 112, such as, air, water, propylene glycol, ethylene glycol or the like. In addition, the configuration of thermal management system 10 is merely illustrative and may be configured to conform to any system, thermal management or otherwise, for regulating a variable.

Figure 2:
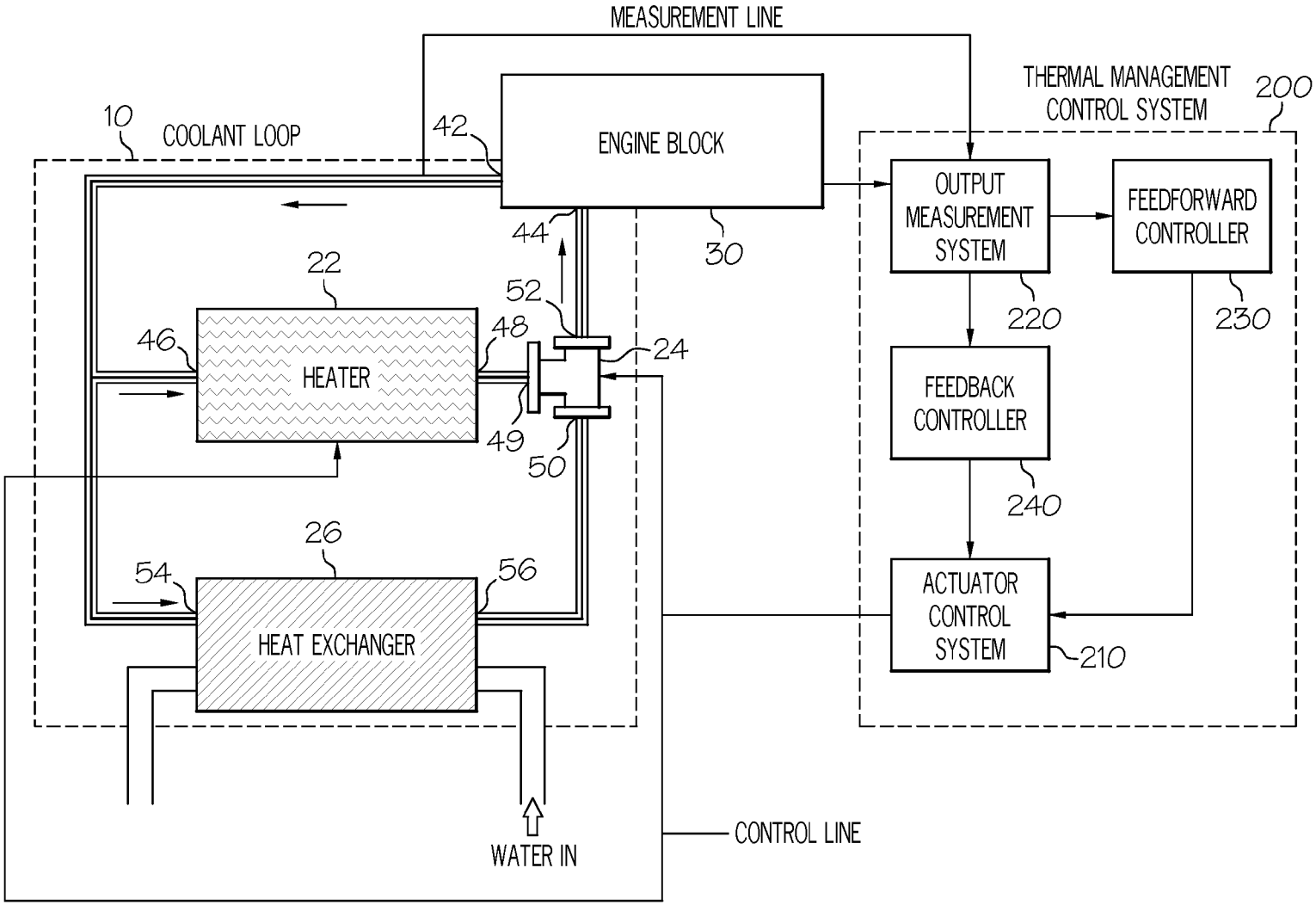
FIG. 2 is a system view of an engine control system for a thermal management system for regulating an engine variable in accordance with one illustrative embodiment of the present invention.

Referring to FIG. 2, coolant system 12 is illustrated in this embodiment as comprising a heater 22, a mixing regulator 24 and a heat exchanger 26 for regulation and delivery of engine cooling/heating media. Heater 22 may be operable to heat engine media provided therethrough. Heater 22 may comprise any device for heating media, such as an electro-resistive element, a microwave generator, a combustion chamber or the like. Contrarily, heat exchanger 26 may be operable to cool engine media provided therethrough. Heat exchanger 26 may comprise any device for cooling media, such as a radiator, a fan, a refrigerant or the like. Mixing regulator 24 may be operable to couple sources of engine media and selectively combine the sources for delivery. Mixing regulator 24 may comprise any device for coupling sources of engine media and selectively combining the sources, including a mixing valve.

In one embodiment, heater 22 and heat exchanger 26 may be provided with inlets and outlets for facilitating media circulation, namely a heater inlet 46, a heater outlet 48, a heat exchanger inlet 54 and a heat exchanger outlet 56. Likewise, engine block 30 may be provided with a block outlet 42 and a block inlet 44 for communicating and receiving circulated engine media. In other embodiments, however, heater 22, heat exchanger 26 and engine block 30 may include additional inlets and outlets to provide for additional circulation capability.

In one embodiment, mixing regulator 24 may include a first regulator input 49, a second regulator input 50 and a regulator output 52 for coupling the engine media received from heater 22 and heat exchanger 26 and selectively combining the media for delivery to engine block 30. In other embodiments, mixing regulator 24 may include additional inlets and outlets to provide for additional regulation and circulation capability.

In one embodiment, mixing regulator 24 may regulate the amount of engine media provided to heater 22 and heat exchanger 26 and may be operable to combine the resulting media from heater 22 and heat exchanger 26 for delivery to engine block 30. In one embodiment, block inlet 42 may be in concurrent communication with heater 22 and heat exchanger 26, such that engine media is directed to both heater 22 and heat exchanger 26, simultaneously. Heater 22 and heat exchanger 26 may be in communication with a first regulator input 49 and a second regulator input 50, respectively. Additionally, regulator output 52 may be in communication with engine block inlet 44. In this example, media from engine block 30 may be simultaneously and selectively circulated through heater 22 and/or heat exchanger 26 and selectively combined via mixing regulator 24. Mixing regulator 24, being in communication with heater 22, heat exchanger 26 and engine block 30, may regulate the volumes of engine media communicated through heater 22 and heat exchanger 26 and may deliver the resulting combination to engine block 30. It should be understood that the configuration of engine block 30, heater 22, heat exchanger 26 and mixing valve 24, and all corresponding inlets 44, 46, 49, 50 and 54 and outlets 42, 48, 52 and 56 are merely illustrative and may be configured to conform to any thermal management system.

Still referring to FIG. 2, engine control system 200 may be utilized in thermal management system 10 to regulate an engine variable, such as temperature, by simultaneously controlling actuators, such as heater 22 and mixing regulator 24. As illustrated in the embodiment, engine control system 200 may comprise actuator control system 210, measurement system 220, feedforward control system 230, and feedback control system 240. In such an embodiment, engine control system 200 may monitor engine block temperature measured by measurement system 220. In addition, engine control system 200 may employ actuator control system 210 to selectively and simultaneously control heater 22, mixing regulator 24, or any other actuator implemented. Actuator control system 210, may selectively control actuators by transmitting control inputs to each actuator. In this embodiment, actuator control system 210 may control heater 22 and mixing regulator 24 by driving a voltage level associated with heater 22 and mixing regulator 24. However, actuator control system 210 may control actuators using methods currently known in the art or later developed, such as via current control, digital communication, or other control methodology. Output measurement system 220 may measure the variable of a given system. In the illustrative embodiment, output measurement system 220 may measure the temperature of thermal management system 10. In such an embodiment, output measurement system 210 may be a thermometer, a thermistor or other temperature sensor. However, depending on the application, output measurement system 220 may include a tachometer, a pressure sensor, a speedometer, or any other system for measuring variables to be controlled. As should be understood, the inventive aspects of the system and methods herein could be used to regulate vehicle variables through actuator control, such as systems having more actuators (inputs) then controlled variables (or outputs), for example. For instance, in an idle speed control system, the actuators may regulate throttle and spark to control engine speed. In yet another instance, a vehicle stability control system may regulate brake pressures by actuating vehicle brake pads to control oversteering or understeering characteristics.

Figure 3:
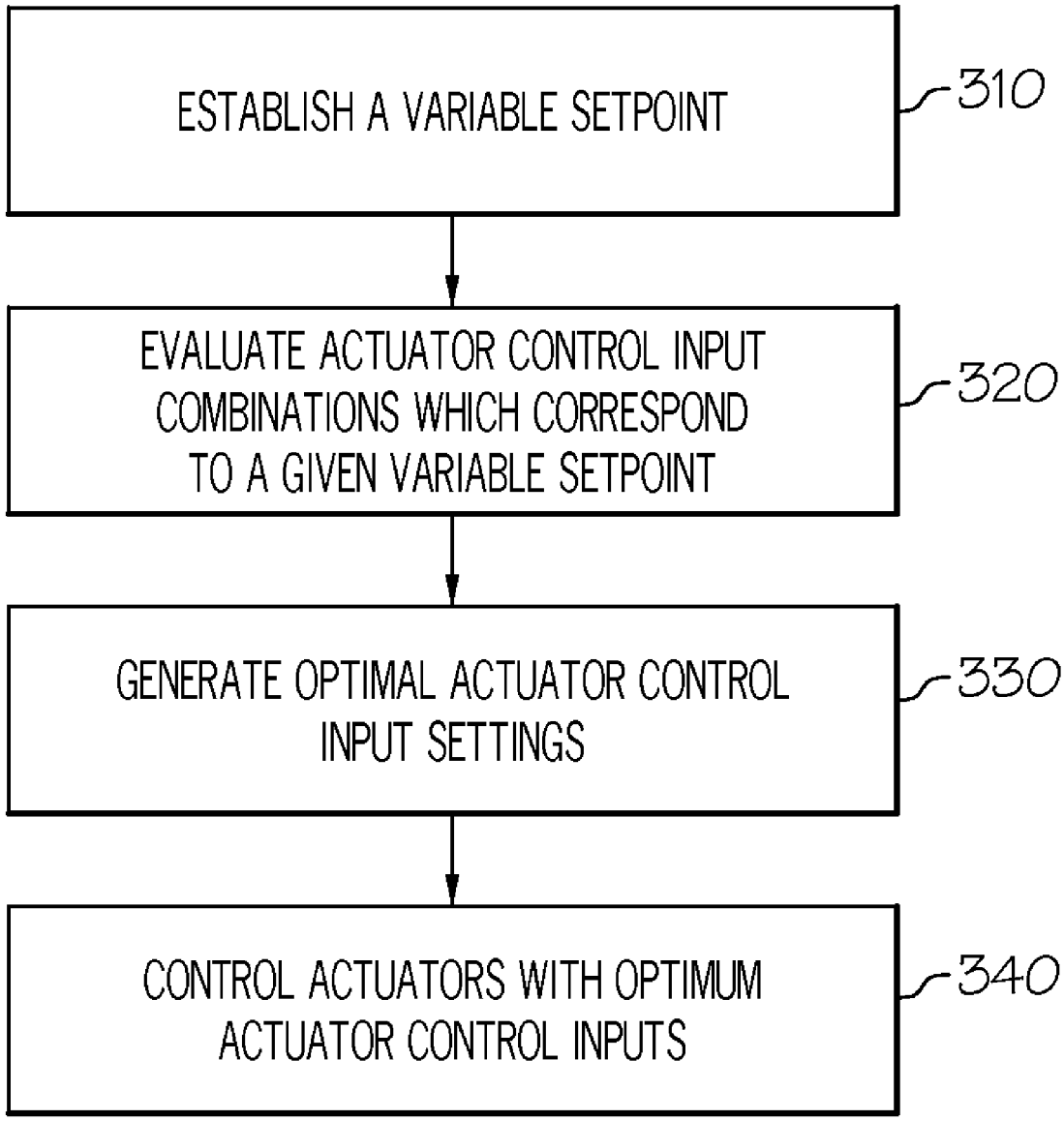
FIG. 3 is a flowchart of one method for feedforward control of an engine variable in accordance with one illustrative embodiment of the present invention.
Figure 4:
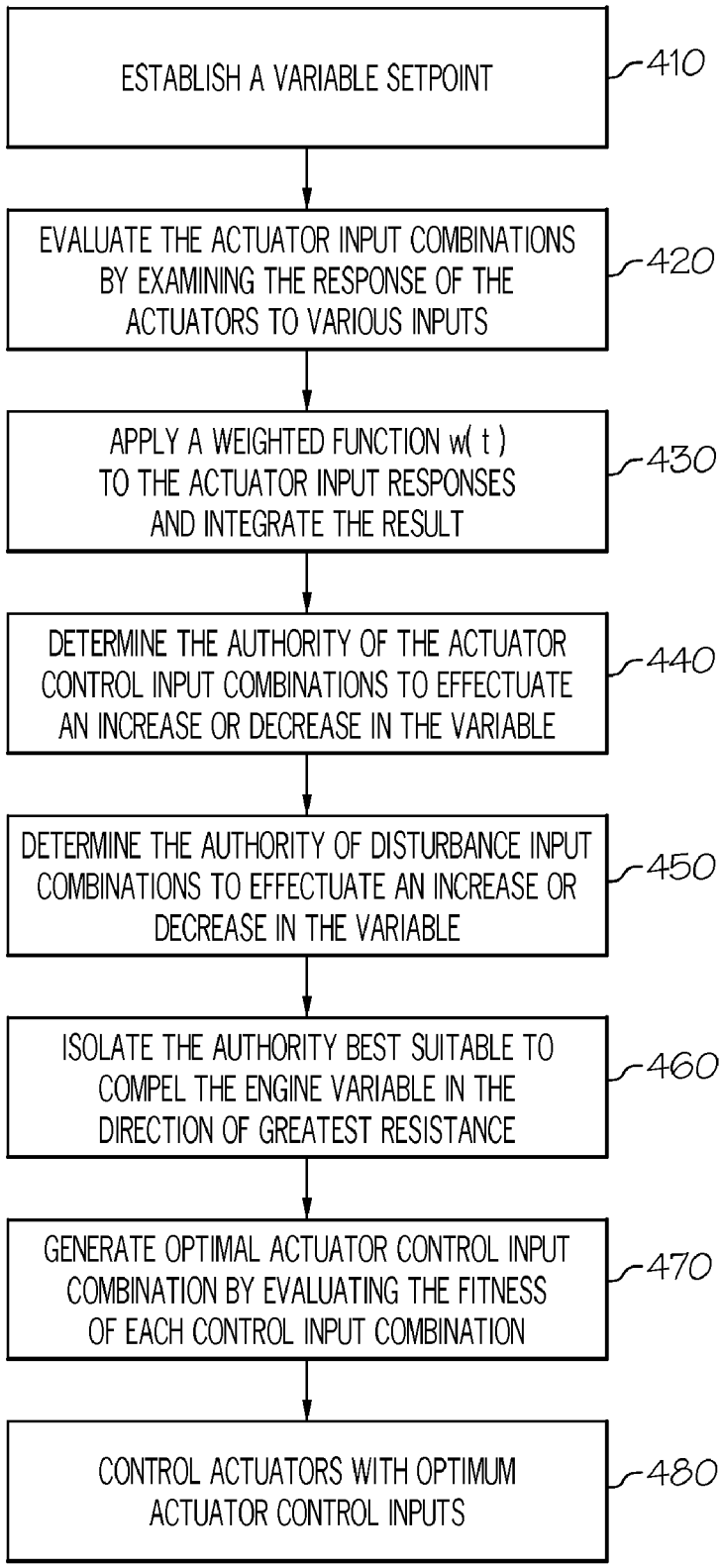
FIG. 4 is a flowchart of one method of feedforward control of an engine variable in accordance with one illustrative embodiment of the present invention.

Now referring to FIGS. 2-4, feedforward control system 230 may calculate actuator control inputs which may accordingly regulate a variable to a desired setpoint. As illustrated in the embodiment, feedforward control system 230 may utilize an optimization method, such as a fitness function, as set forth in FIGS. 3 & 4 and below. In such an embodiment, feedforward control system 230 may read temperature measurements acquired by output measurement system 220 and may correspondingly control heater 22 and mixing regulator 24 via actuator control system 210. Feedforward control system 230 may comprise an algorithmic operator, a processor, a microcontroller, an electronic control unit, processing circuitry, or any similar system for implementing an algorithm to calculate optimum inputs.

As shown in FIGS. 3 & 4, an optimization method may be implemented to optimally regulate a variable to a desired setpoint. In the illustrative embodiment, the method may include establishing a variable setpoint, evaluating actuator control input combinations which correspond to a given variable setpoint, generating optimal actuator control input settings, and controlling actuators with optimum actuator control inputs. In another illustrative embodiment, the method may include establishing a variable setpoint, evaluating the actuator input combinations by examining the simulated response of the actuators to various inputs, applying a weighted function w(t) to the actuator input responses and integrating the result, determining the authority of the actuator control input combinations to effectuate an increase or decrease in the variable, determining the authority of disturbance input combinations to effectuate an increase or decrease in the variable, isolating the authority best suitable to compel the engine variable in the direction of greatest resistance, generating optimal actuator control input combination by evaluating the fitness of each control input combination, and controlling actuators with optimum actuator control inputs.

In particular and referring to FIGS. 2-4, and as shown in blocks 310 and 410, a variable setpoint may be established. The setpoint may correspond to a desired value or range of values to be regulated by a management system. In the illustrative embodiment, the variable setpoint may be a particular engine block temperature. However, in other embodiments, the setpoint may represent a pressure level, vehicle speed or any other variable which may be regulated by actuators.

In management systems, such as thermal management system 10, many actuator control input combinations may correspond to a given variable setpoint. In the illustrative embodiment for instance, the same engine block temperature setpoint may be achieved by either fully actuating heater 22 while partially actuating mixing regulator 24 or partially actuating heater 22 while fully actuating mixing regulator 24. While different actuator control input combinations may ultimately produce the same setpoint, optimum overall system performance may be achieved by choosing an input combination that provides optimal setpoint response times, optimal ability to change the variable and optimal capability to compensate for disturbances. In the illustrative embodiment, in order to determine the optimum actuator control inputs, feedforward control system 230 may incorporate a fitness function:

$$F=F_r F_d^{\eta}$$

Defining the algorithm terms: $F_r$ may be characterized as a setpoint tracking fitness (i.e., the ability of the actuators, for a given input combination, to change the engine variable); $F_d$ may be characterized as a disturbance rejection fitness (i.e., the capability of the actuators, for a given input combination, to reject engine disturbances); and $\eta$ may be defined as a weighting parameter for indicating the relative importance of disturbance rejection fitness, $F_d$, to setpoint tracking fitness, $F_r$.

The setpoint tracking fitness $F_r$ and disturbance rejection fitness $F_d$ may be determined by actuator authority and disturbance authority, i.e., the ability of the actuators and disturbances, respectively, to effectuate a change in the variable for a given actuator control input combination. Therefore, to calculate an optimal actuator control input combination, the actuator authority and disturbance authority may be evaluated.

As shown in block 320, the feedforward control system 230 may evaluate actuator and disturbance authority by examining the response of the actuators to various inputs, as shown by 420. In the illustrative embodiment, to evaluate the actuator authority, the feedforward control system 230 (or other evaluation or control system) may simulate the response to a saturating control input to each actuator (or, alternatively, actually apply a saturating input to each actuator, if appropriate), in the same direction (i.e., either increasing inputs may be applied—resulting in a variable increase or decreasing inputs may be applied—resulting in a variable decrease). The saturating control inputs may correspond to the highest or lowest actuator input that does not saturate each actuator and may be represented as $u_{sat,inc}$ and $u_{sat,dec}$, respectively. The response of the variable to the saturating control inputs $u_{sat,inc}$ and $u_{sat,dec}$ may be represented by the following equation:

$$\Delta y_{u,inc}=y(u_{sat,inc})-y(u_0)$$

$$\Delta y_{u,dec}=-y(u_{sat,dec})+y(u_0)$$

Where $u_0$ may be a vector of nominal inputs to each actuator in order to achieve the desired setpoint (i.e., actuator control input combinations).

In the same illustrative embodiment, to evaluate the disturbance authority, the feedforward control system 230 (or other evaluation or control system) may apply a disturbance input to the actuators. The disturbance input may correspond to operating conditions which disturb the steady state of the variable, namely, environmental parameters, such as engine speed, load, ambient temperature, and the like. Such disturbance inputs may be represented as $d_{var,inc}$ and $d_{var,dec}$. The response of the variable to the disturbance inputs $d_{var,inc}$ and $d_{var,dec}$ may be represented by the following equation:

$$\Delta y_{d,inc}=y(d_{var,inc})-y(d_0)$$

$$\Delta y_{d,dec}=-y(d_{var,dec})+y(d_0)$$

Where $d_0$ is a vector of disturbance inputs, such as engine speed, load, and cooling water properties (i.e., disturbance input combinations). It should be understood that the inputs and responses correspond to the illustrative embodiment and that other inputs and responses may be utilized for evaluation of a particular management system.

In order to evaluate the actuator authority, the transient behavior of the control input combinations may be evaluated with respect to variable responses $\Delta y_{u,inc}$ and $\Delta y_{u,dec}$. To evaluate the transient behavior of the actuator input combinations, the feedforward control system 230 may apply a weighted function w(t) to the variable responses and integrate the result over time, as shown by block 430. The resulting weighted integrals may represent the actuator authority, i.e., the authority that control input combinations have to effectuate an increase or decrease in the variable, as shown in block 440. The weighted function w(t) may comprise a decaying exponential but may also be any function operative to extract and emphasize transient behavior. The authority of the actuator control input combinations to effectuate an increase or decrease in the variable may be represented by the following equations:

$$a_{auth}^{+} = \int_0^T w(t)\Delta y_{u,inc}(t)\,dt$$

$$a_{auth}^{-} = \int_0^T w(t)\Delta y_{u,dec}(t)\,dt$$

where T may be chosen to be at least larger than the slowest actuator responses.

It should be understood that to evaluate the disturbance authority for various disturbance input combinations, the transient behavior of the disturbance input combinations may be evaluated with respect to variable responses, $\Delta y_{d,inc}$ and $\Delta y_{d,dec}$. Similar to above and as shown by block 430, the feedforward control system 230 may apply a weighted function w(t) to the variable responses and may integrate the result over time. The resulting weighted integral may represent the disturbance authority, i.e., the authority of the disturbance input combinations to effectuate an increase or decrease in the variable, as shown in block 450. The authority of the disturbance input combinations to effectuate an increase or decrease in the variable may be represented by the following equations:

$$d_{auth}^{+} = \int_0^T w(t)\Delta y_{d,inc}(t)\,dt$$

$$d_{auth}^{-} = \int_0^T w(t)\Delta y_{d,dec}(t)\,dt$$

To determine the optimum setpoint tracking and disturbance rejection fitnesses, authorities can be evaluated under the worst case. For calculating setpoint tracking fitness, this represents the actuator authority which compels the variable in the direction of greatest resistance. For example and with respect to the illustrative embodiment, different engine operating conditions may cause one objective to be more difficult to achieve than another. At low speed and load, it may be more difficult to increase temperature. Contrarily, at high speed and load, decreasing temperature becomes more difficult. Therefore, feedforward control system 230 may isolate the worst-case actuator authority by applying a minimum function. The setpoint tracking fitness may be represented by the following equation:

$$F_r = \min\{a_{auth}^{+}, a_{auth}^{-}\}$$

Similarly, disturbance rejection fitness for the worst case may be defined. A disturbance that tends to decrease the variable will require an actuator effort that tends to increase it, and vice versa. Large actuator authority is beneficial to disturbance rejection, and large disturbance authority is harmful, so disturbance rejection fitness can be defined as a ratio of the two, under the worst case. The resulting disturbance authority may be represented by the following equation:

$$F_d = \min\left\{\frac{a_{auth}^{+}}{d_{auth}^{-}}, \frac{a_{auth}^{-}}{d_{auth}^{+}}\right\}$$

Figure 5:
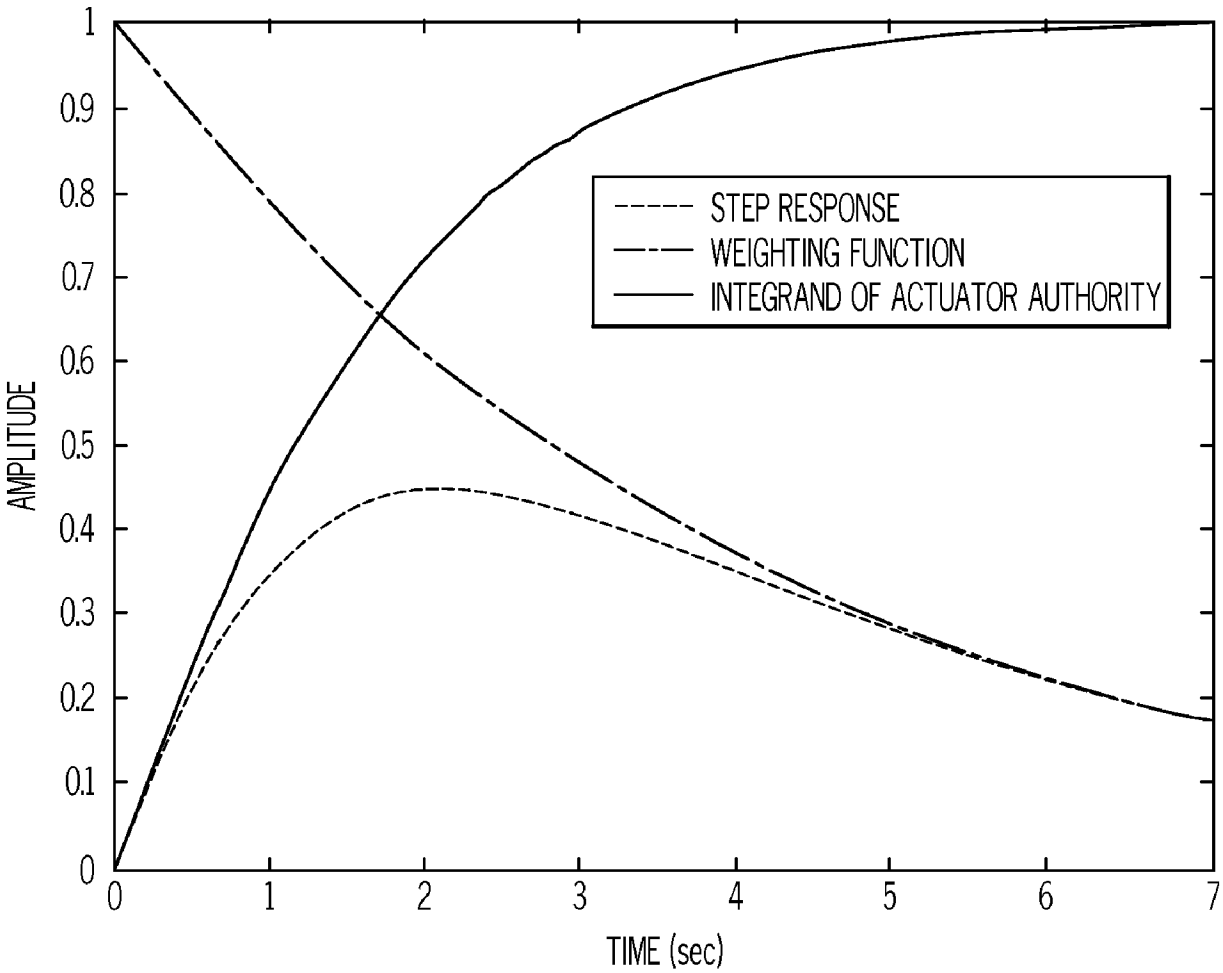
FIG. 5 is a graph depicting calculation of authority of actuators in accordance with one illustrative embodiment of the present invention.

FIG. 5 illustrates a graph of the result of calculating an authority, where the value of the resulting integral (area under the "integrand of actuator authority" curve) may represent the authority.

Feedforward control system 230 may input the authorities $F_r$ and $F_d$ into the following total fitness function:

$$F = F_r F_d^{\eta}$$

As shown in block 330 and 470, feedforward control system 230 may generate the actuator input combination which provides optimum overall performance (i.e., optimal setpoint response times, optimal ability to change the variable and optimal capability to compensate for engine disturbances) by evaluating the fitness, F, for each actuator control input combination.

As shown in blocks 340 and 480 and also described above, the feedforward control system 230 may transmit the optimum actuator control input combination via actuator control system 210 to each actuator. The control of the temperature or other variable is thereby optimized and the two actuators are simultaneously controlled by the feedforward control system 230.

Figure 6:
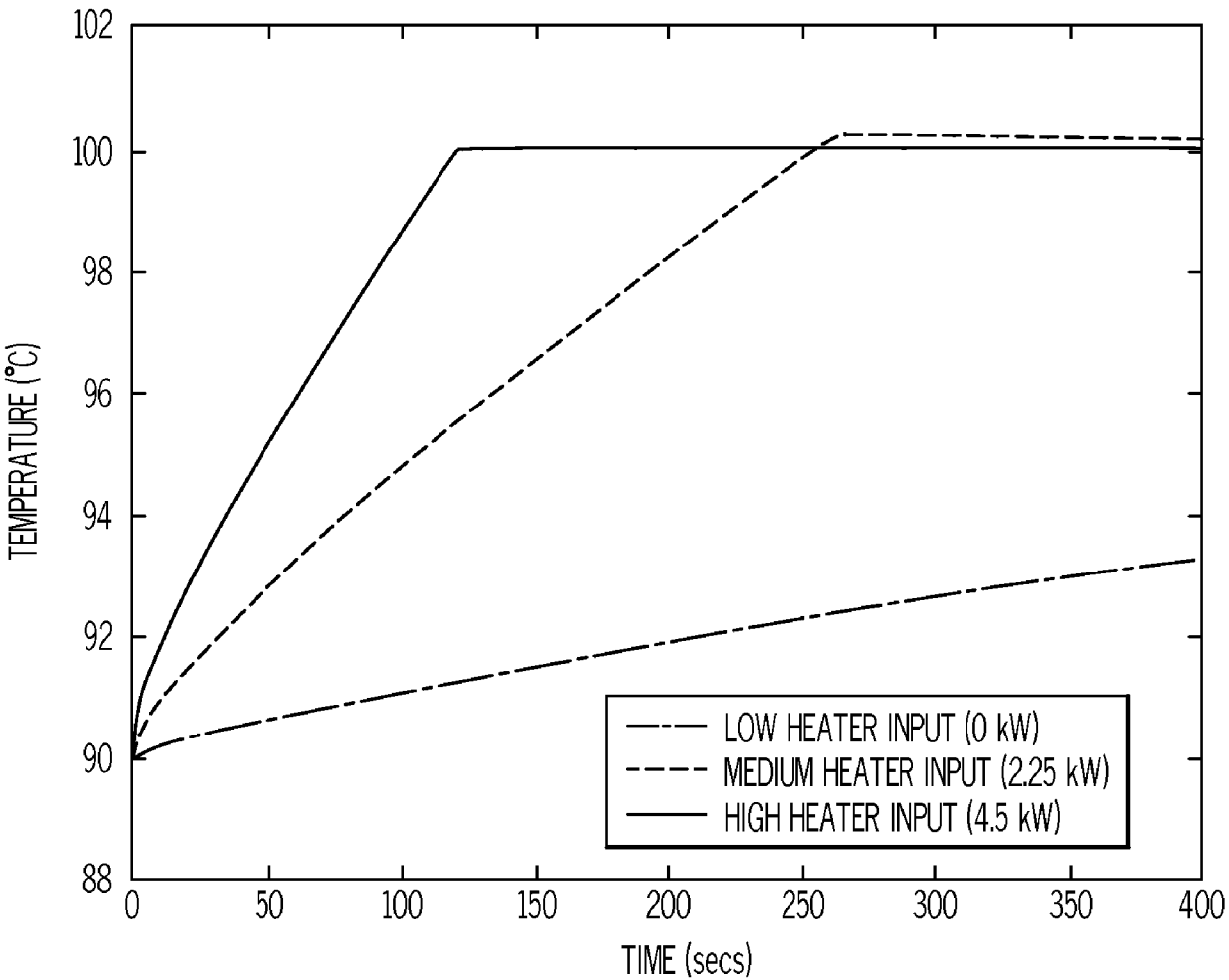
FIG. 6 is a graph depicting setpoint response as a function of heater inputs in accordance with one illustrative embodiment of the present invention.

The foregoing methods and embodiments may be illustrated by FIG. 6. The graph depicted in FIG. 6 is merely illustrative of the effectiveness of the fitness function. The optimum actuator control input combination fed forward to the actuators provides for fast variable response.

As can be understood, the functionality of the models, methods, and algorithms described herein can be implemented using software, firmware, and/or associated hardware circuitry for carrying out the desired tasks. For instance, the various functionalities described can be programmed as a series of instructions, code, or commands using general purpose or special purpose programming languages, and can be executed on one or more general purpose or special purpose computers, controllers, processors or other control circuitry.

Thermal management system 10 is not limited to dynamometer testing and may be employed to maximize variable control during vehicle operation. For example, the engine control system 200 could be provided as part of a vehicle to control temperature during driving operation.

The foregoing description of the various embodiments of the invention has been presented for the purposes of illustration and description. It is not intended to be exhaustive or to limit the inventions to the precise forms disclosed. Many alternatives, modifications and variations will be apparent to those skilled in the art of the above teaching. For example, the system for regulating engine variables in accordance with the present invention may establish a set point, evaluate actuator control inputs which result in a given variable setpoint, generate an optimal actuator input setting and control an actuator with the optimal input setting. Accordingly, while some of the alternative embodiments of the system for regulating engine variables have been discussed specifically, other embodiments will be apparent or relatively easily developed by those of ordinary skill in the art. Moreover, although multiple inventive aspects and features have been described, it should be noted that these aspects and features need not be utilized in combination in any particular embodiment. Accordingly, this invention is intended to embrace all alternatives, modifications, combinations and variations.

What is claimed is:

1. An engine control system comprising:

at least two actuators wherein the at least two actuators regulate one or more engine variables, the number of engine variables being less than the number of actuators; and at least one controller operative to apply inputs to the at least two actuators to evaluate a response of the actuators, wherein the at least one controller is further operative to use the response for simultaneous feedforward control of the actuators for control of the engine variable.

2. The system as recited in claim 1, wherein the actuators comprise a heater configured to heat liquid for an engine and a mixing regulator configured to mix hot and cool liquid.

3. The system as recited in claim 1, wherein the controller is operative to evaluate the response to determine the ability of the actuators to change the engine variable; and determine the capability of the actuators to reject a disturbance.

4. The system as recited in claim 3, wherein the controller is operative to calculate a fitness based upon the capacity and capability determined.

5. The system as recited in claim 4, wherein the controller is further operative to calculate an optimum actuator feedforward control setting based upon the fitness; and control the actuators with the calculated setting.

6. The system as recited in claim 1, further comprising an engine; wherein the engine comprises a coolant system having coolant system media; wherein the actuators comprise a heater configured to heat the coolant system media and a valve configured to mix the coolant system media.

7. A method for controlling an engine variable with at least two actuators, the method comprising:

providing inputs to at least two actuators which regulate the variable;

evaluating the response of the actuators;

determining the ability of the actuators to change the engine variable;

determining the capability of the actuators to reject a disturbance;

calculating a fitness function based upon the ability and capability determined; and controlling the actuators using the calculated function and a feedforward control algorithm.

8. The method as recited in claim 7, wherein the actuators comprise a heater configured to heat liquid for an engine and a mixing regulator configured to mix hot and cool liquid, and wherein the providing operation is conducted by simulating the inputs.

9. The method as recited in claim 7, wherein the evaluation operation comprises applying a weighing function to the response of the actuators for a given input.

10. The method as recited in claim 9, wherein the evaluation operation further comprises integrating the response of the actuators for a given input.

11. The method as recited in claim 7, wherein the capability is determined by calculating a disturbance authority based upon disturbance inputs in the direction of variable increase and variable decrease.

12. The method as recited in claim 7, wherein the ability is determined by determining an actuator authority based upon saturating control inputs in the direction of variable increase and variable decrease.

13. The method as recited in claim 7, wherein an optimum actuator setting is determined from the fitness function, and wherein the method further comprises using a feedback loop to provide robustness to uncertainties and unmeasured disturbances.

14. A method for feedforward control of an engine variable wherein at least two actuators regulate an engine variable, the method comprising:

establishing an engine variable setpoint;

evaluating the fitness of the actuators to produce the setpoint;

generating optimal actuator input settings; and controlling the actuators with the optimal actuator input settings using a feedforward control.

15. The method as recited in claim 14, wherein the actuators comprise a heater configured to heat engine fluid and a mixing regulator configured to mix hot and cool liquid.

16. The method as recited in claim 14, wherein evaluating the fitness includes determining the authority of the actuators to change the variable.

17. The method as recited in claim 14, wherein evaluating the fitness includes determining the authority of the actuators to reject a disturbance.

18. The method as recited in claim 14, wherein evaluating the fitness includes evaluating the ability of the actuators to effect a change in the variable.

19. The method as recited in claim 14, wherein evaluating the fitness includes applying disturbance inputs to said actuators in the direction of variable increase and variable decrease, and evaluating the response of said actuators.

20. The method as recited in claim 14, wherein evaluating the fitness includes applying saturating control inputs to said actuators in the direction of variable increase and variable decrease, and evaluating the response of said actuators.

* * * * *